United States Patent [19]

Fedorchenko et al.

[11] 4,011,877

[45] Mar. 15, 1977

[54] MOUTHPIECE FOR SMOKING TOBACCO

[76] Inventors: Ivan Mikhailovich Fedorchenko, ulitsa Vladimirskaya, 51/53, kv. 32; Vasily Sergeevich Pugin, ulitsa Dobrokhoiova, 2, kv. 32; Vladimir Itskhok-Nukhimovich Ablov, ulitsa Pozharskogo, 2, kv. 23; July Yakovlevich Fridman, Novo-Gostomelskoe shosse, 17, kv. 65; Mikhail Shaevich Goldberg, ulitsa Patrisa Lumumby, 20, kv. 59, all of Kiev, U.S.S.R.

[22] Filed: Feb. 26, 1976

[21] Appl. No.: 661,805

Related U.S. Application Data

[63] Continuation of Ser. No. 507,530, Sept. 19, 1974, abandoned, which is a continuation of Ser. No. 344,029, March 22, 1973, abandoned.

[30] Foreign Application Priority Data

June 12, 1972 U.S.S.R. ..... 1790302

[52] U.S. Cl. ..... 131/187; 131/194; 131/210; 131/211

[51] Int. Cl.[2] ..... A24F 13/04; A24F 1/08

[58] Field of Search ..... 131/187, 210, 211, 10 R, 131/264

[56] References Cited

UNITED STATES PATENTS

| | | | |
|---|---|---|---|
| 214,586 | 4/1879 | Riedel | 131/211 X |
| 267,070 | 11/1882 | Franke | 131/210 |
| 2,588,693 | 3/1952 | Bowles | 131/211 X |
| 3,163,168 | 12/1964 | Lytton | 131/210 |
| 3,194,246 | 7/1965 | Mantchev | 131/187 |
| 3,313,308 | 4/1967 | Grasso | 131/210 X |
| 3,367,343 | 2/1968 | White et al. | 131/187 |
| 3,631,866 | 1/1972 | Bottazzi | 131/210 |
| 3,756,251 | 9/1973 | Terasaki | 131/210 X |

FOREIGN PATENTS OR APPLICATIONS

| | | | |
|---|---|---|---|
| 121,415 | 3/1944 | Australia | 131/10 R |
| 1,948,778 | 12/1970 | Germany | 131/194 |

*Primary Examiner*—Stephen C. Pellegrino
*Attorney, Agent, or Firm*—Holman & Stern

[57] ABSTRACT

A mouthpiece which comprises two filters for purifying tobacco smoke: a rough purification filter and a fine purification filter. The rough purification filter is intended to convert the resin vapors contained in the smoke into a liquid and to settle down the vapors on the inner surface of the body, and the fine purification filter is fabricated from a porous sintered metal material catching up to 80 per cent of the toxic agents.

4 Claims, 1 Drawing Figure

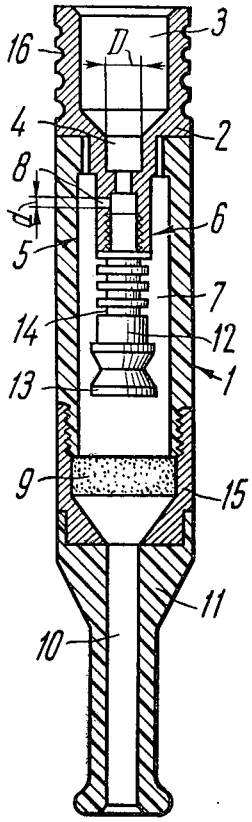
16
3
D
4
2
8
d
6
5
7
14
12
13
1
9
15
11
10

MOUTHPIECE FOR SMOKING TOBACCO

This is a continuation of application Ser. No. 507,530 filed Sept. 19 1974, now abandoned, which in turn is a continuation of application Ser. No. 344,029 filed Nov. 22, 1973, now abandoned.

The present invention relates to appliances for smoking and, more particularly, to mouthpieces for smoking tobacco articles such as cigarettes.

Known in the art are mouthpieces for smoking tobacco or tobacco articles incorporating a hollow body with a filter member made of sintered metal material located therein and a holder whose one end is fastened to the body, with the tobacco or tobacco articles being placed into the holder. The holder has an inlet channel for the passage of smoke.

However such mouthpieces do not ensure a most efficient cooling of the entire flow of smoke and are not effective enough for fighting the toxic agents and detrimental constituents of the tobacco smoke, such as polycyclic hydrocarbons, in particular, benzopyrene, pesticides of D.D.T. and its metabolites. The filtered members of sintered metal material in the mouthpieces of the prior art are soon clogged up as a result of accumulation, cooling and condensation of resins directly on the filter member, and are used for smoking two or three cigarettes.

The main object of the present invention is to provide a mouthpiece for smoking tobacco and tobacco articles which increases the degree of cleaning the tobacco smoke from toxic agents and detrimental constituents, in particular, such as the pesticides of the D.D.T. and its metabolites.

Another object of the invention is to provide a mouthpiece which will have a longer service life as compared to the mouthpieces of the prior art.

The above-mentioned and other objects are accomplished in a mouthpiece for smoking tobacco and tobacco articles incorporating a hollow body located in which is a filter member of sintered-metal material and a holder for placing tobacco or tobacco articles therein having an inlet channel for the passage of smoke. According to the invention, the end of the holder is located in the cavity of the body so that an unobstructed space is formed between the inner surface of the body and the outer surface of the said end of the holder for the passage of smoke, this space being connected to the inlet channel through a radial orifice formed on the said end of the holder and having a diameter which is considerably smaller than the diameter of the inlet channel in order to convert the vapours of resins contained in the smoke into a liquid and to make them settle on the inner surface of the body.

The above mentioned design of the mouthpiece increases the rate of cleaning tobacco smoke from detrimental constituents and ensures a longer service life (eight - or tenfold).

It is expedient that the body of the mouthpiece should be constructed detachable in the plane perpendicular to its longitudinal axis, with the filter member being placed in one detachable portion, and the holder being fastened to the other portion, thereby ensuring convenient filling and cleaning of the mouthpiece.

It is advisable that the holder should have a stem located in the cavity of the body, with annular concentric grooves being formed on the outer surface of the stem in order to increase the contact area for the smoke and to settle down the condensation products, the grooves passing into an expanded base serving to protect the filter member against the resins and having a smaller cross-sectional area than that of the cavity of the body to ensure a further passage for the smoke.

It is expedient to form grooves on the outer surface of the holder to increase the area for heat dissipation. Also to increase the area for heat dissipation, it is most expedient that the holder and the stem be fabricated from a heat-conducting material.

To further increase dissipation of heat formed in the process of burning the tobacco, it is expedient to enclose the filter member into the bushing constructed integrally with the body from a heat-conducting material.

BRIEF DESCRIPTION OF THE DRAWING

The present invention is illustrated herein by a detailed description of a specific embodiment, by way of example, with reference to the accompanying drawing presented wherein there is provided a general view with a longitudinal cross-section of the mouthpiece constructed according to the invention.

DESCRIPTION OF THE PREFERRED EMBODIMENTS

The disclosed mouthpiece for smoking tobacco or tobacco articles, e.g., cigarettes is constructed in the form of a hollow body I. The most convenient form of its outer and inner surfaces is a cylindrical form. The body may be constructed as a unit but for the sake of convenient filling and cleaning the body I is constructed detachable in the plane perpendicular to the longitudinal axis. Fastened to one detachable portion in the cavity of the body I co-axially therewith is the holder 2 which is also hollow to fill its cavity 3 with tobacco or tobacco articles. The holder 2 has an inlet smoke channel 4 located along the longitudinal axis of the holder 2 and in communication with the said cavity 3.

The holder 2 is fastened to the body I so that its one end is located in the cavity of the body I and a free space 7 is formed for the passage of smoke between the inner surface 5 of the body I and the outer surface 6 of the said end of the holder 2, this space being in communication with the inlet channel 4 through a radial orifice 8 formed on the end of the holder 2 located in the cavity of the body I and intended for the passage of smoke. To convert the resin vapours comprised in the smoke into a liquid and to settle them down on the inner surface 5 of the body I, the diameter *d* of the radial orifice 8 is selected to be considerably smaller than the diameter D of the inlet channel 4.

Located co-axially with the body I is the filter member 9 fabricated from sintered metal material. It is advisable to make use of sintered metal powders of fibres of nickel, aluminium, silver, gold, stainless steel taken in combination or separately.

The filter member 9 is located in the cavity of the body I so that the outlet channel 10 is divided for the smoke to proceed to the mouth of the smoker. The outlet channel 10 is located along the longitudinal axis of the body I in the tip II in which this detachable portion of the body I terminates.

Fastened to the end of the holder 2 located in the body I is a stem 12 having an enlarged base 13 and serving to protect the filter member 9 against resins. Concentric grooves 14 passing into the base 13 are formed on the outer surface of the stem 12 to increase the contact area of the smoke flowing in the free space 7 of the body I and to settle down the condensation products.

To increase dissipation of heat formed in the process of burning the tobacco, the filter member 9 is enclosed in the bushing 15 whose outer surface is constructed to be flush with the outer surface of the detachable portion of the body I, and the bushing 15 is fabricated from a heat-conducting material.

To increase the heat dissipation area, grooves 16 are formed on the outer surface of the holder 2 located outside the body I, and the holder 2 and the stem 12 are fabricated from a heat-conducting material.

To make provisions for the replacement or regeneration of the filter member 9, the bushing 15 is constructed detachable both from the body I and from the tip II.

Proceeding from the proposed construction, one might say that the mouthpiece contains two filters for the purification of tobacco smoke: the rough purification filter which encompasses the inlet channel 4 for the smoke, the radial orifice 8 in the holder 2, the free space 7 in the cavity of the body I, the expanded base 13 of the stem 12 and the fine purification filter which is fabricated from a porous sintered metal material.

The process of the passage of the smoke and its purification in the mouthpiece is as follows.

On igniting tobacco or tobacco article placed in the cavity 3 of the holder 2 the generated tobacco smoke proceeds to the rough purification filter, i.e. it moves along the inlet channel 4 of the holder 2 through the radial orifice 8 to the free space 7. There, the smoke, expanding, cools off and gives away the heat to the metal portions. The resins comprised in the smoke condensate and settle down in droplets onto the inner surface 5 of the body I and the outer surface of the stem 12. The expanded base 13 makes the smoke overflow the inner surface 5 of the body I and, what is more, to settle down thereon the droplets of resins still contained in the tobacco smoke.

As this takes place, the base 13 of the stem 12 also inhibits the resins from settling down on the filter member 9. Then the smoke, being partially cooled off and devoid of resins, proceeds to the fine purification filter which is fabricated from a porous sintered metal material. As a result of such a purification, the smoke that gets into the smoker's mouth is purified from aerosol particles by not less than 82 per cent, from polycyclic aromatic hydrocarbons, in particular, benzypyrene, by not less than 70 per cent, and from toxic agents, such as the D.D.T. and its metabolites - by not less than 40 per cent.

In addition, the disclosed design of the mouthpiece increases its service life eight or tenfold improving at the same time the efficiency of the sintered metal filter.

Another advantage of the proposed mouthpiece is that the taste qualities of tobacco are not lost but, moreover, improve due to the purification of the tobacco smoke while passing though the mouthpiece.

What is claimed is:

1. A mouthpiece for smoking tobacco and tobacco articles, comprising: a body member having a cavity; a filter member made of sintered metal material and located axially in said cavity of said body; a holder arranged co-axially with said body, said holder having a cavity designed to contain tobacco or tobacco articles; an inlet channel for the passage of smoke in said holder in communication with said cavity of said holder; a portion including one end of said holder located in said cavity of said body and removably fastened therein; said holder portion of said body having a radial orifice formed therein communicating with said inlet channel and having a diameter which is considerably smaller than the diameter of said inlet channel, said orifice defining a first reduced area passageway for said smoke to ensure the conversion of the resin vapours in the smoke into a liquid and to settle them down on the inner surface of said body, said end of the holder being spaced from the filter member; the inner surface of said body and a section of the outer surface of said holder portion located in said cavity of said body defining a substantially annular passage in communication with said inlet channel through said radial orifice, said substantially annular passage defining a free space for receiving said smoke from said orifice and in which said smoke expands and cools, said portion of said holder in said body comprising an elongated stem having a plurality of peripheral grooves in its outer surface and terminating in an enlarged free end spaced upstream from said filter means, said enlarged free end and the inner surface of said body defining therebetween a second reduced area passageway for said smoke to further cause the liquid in said smoke to settle on to said enlarged free end, the smoke in said body cavity expanding after passing said second reduced area passageway and then passing through said filter means.

2. A mouthpiece, as set forth in claim 1, wherein said body is constructed detachable in the plane perpendicular to its longitudinal axis, and one of its detachable portions contains said filter member, and the other detachable portion contains said end of said holder.

3. A mouthpiece, as set forth in claim 1, wherein said holder and the stem are fabricated from a heat-conducting material.

4. A mouthpiece, as set forth in claim 1, wherein said filter member is enclosed in a bushing fabricated from a heat-conducting material and whose outer surface is constructed integral with the outer surface of said body.

* * * * *